US008028906B2

(12) United States Patent
Allerding et al.

(10) Patent No.: US 8,028,906 B2
(45) Date of Patent: Oct. 4, 2011

(54) GROUND CONVEYOR WITH A LABEL

(75) Inventors: Uwe Allerding, Embsen (DE); Eiko Matthias, Mount Prospect, IL (US); Carsten Oestman, Hamburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 0 days.

(21) Appl. No.: 11/952,685

(22) Filed: Dec. 7, 2007

(65) Prior Publication Data

US 2008/0136601 A1 Jun. 12, 2008

(30) Foreign Application Priority Data

Dec. 12, 2006 (DE) ..... 10 2006 058 408

(51) Int. Cl.
*G07B 15/02* (2006.01)

(52) U.S. Cl. ..... 235/384; 340/10.5

(58) Field of Classification Search ..... 340/10.2, 340/10.1; 235/385, 384
See application file for complete search history.

(56) References Cited

U.S. PATENT DOCUMENTS 5,995,001 A * 11/1999 Wellman et al. ..... 340/438
6,496,102 B1 * 12/2002 Kyrtsos ..... 340/10.1
7,168,619 B2 * 1/2007 Heusermann et al. ..... 235/385
7,287,625 B1 * 10/2007 Harris ..... 187/282
2005/0052281 A1 3/2005 Bann
2005/0248335 A1 * 11/2005 Care ..... 324/109
2006/0022800 A1 * 2/2006 Krishna et al. ..... 340/10.2
2007/0007080 A1 * 1/2007 Manthey et al. ..... 187/224
2007/0063029 A1 * 3/2007 Brandt et al. ..... 235/385
2008/0303637 A1 * 12/2008 Gelbman et al. ..... 340/10.42
2009/0101447 A1 * 4/2009 Durham et al. ..... 187/238
2011/0074553 A1 * 3/2011 Brown et al. ..... 340/10.1

FOREIGN PATENT DOCUMENTS

DE 10207017 A1 * 8/2003
EP 1 728 758 A2 4/2006

OTHER PUBLICATIONS

Logistik & Fordertechnik, No. 6, Feb. 14, 2006 p. 53 (With attached Statement of Relevancy).
Logistik & Fordertechnik No. 5-10, Oct. 5, 2006, by Klaus Koch, p. 38 (With attached Statement of Relevancy).
Hebezeuge und Fordermittel, Berlin 45, Mar. 3, 2005, by Christian Donges, p. 116-118. (With attached Statement of Relevancy).
Logistik fur Unternehmen (Logistics for Companies), Nov. 12, 2005, p. 15 (With attached Statement of Relevancy).

* cited by examiner

*Primary Examiner* — Seung Lee
*Assistant Examiner* — Sonji Johnson
(74) *Attorney, Agent, or Firm* — Vidas, Arrett & Steinkraus

(57) ABSTRACT

Ground conveyor, which is provided with one or more labels and/or documentation, which contain information on the use and/or safety of the ground conveyor, wherein at least one label or documentation is provided with an RFID transponder, in which data is saved.

5 Claims, 1 Drawing Sheet

GROUND CONVEYOR WITH A LABEL

CROSS-REFERENCE TO RELATED APPLICATIONS

Figure 1:
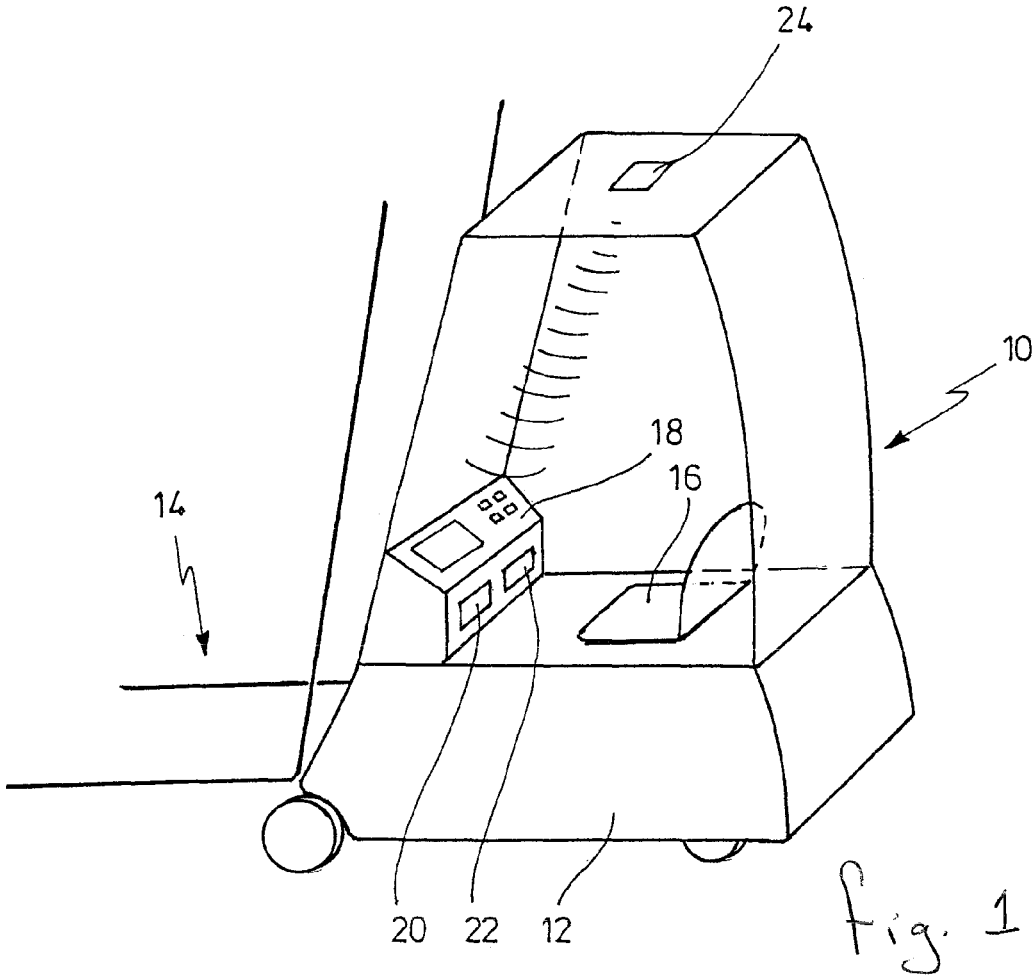

Not applicable.

STATEMENT REGARDING FEDERALLY SPONSORED RESEARCH

Not applicable.

BACKGROUND OF THE INVENTION

The present invention relates to a ground conveyor, which is provided with one or more labels and/or documentation, which contains information on the use and/or safety of the ground conveyor.

Ground conveyors are provided with all types of signage, whereby many of the signs serve to provide information to the driver. One example of such a label is the sign provided on fork lifts indicating which load can be lifted to what height. Other labels regularly provided on fork lifts relate to switch and button assignments on an operating panel and warning messages. Components of the ground conveyor also have labels, which contain information on the exact type designation of the component, the manufacturer and other specific information on the component.

It is known from "Hebezeuge und Fördermittel" (Lifting Tools and Conveyors), Berlin 45 (2005), page 116 f., the entire contents of which is incorporated herein by reference, to use RFID transponders for special applications in the area of logistics. The goal of the use of the transponders is to additionally label individual goods using individual serial numbers for product information and to perform an automatic identification without a manual intervention.

From "Logistik für Unternehmen" (Logistics for Companies) 11/12-2005, the entire contents of which is incorporated herein by reference, on the occasion of the CeMAT 2005, the use of RFID transponders for the localization of ground conveyors in a warehouse is known. For this, RFID transponders are installed in the floor of the warehouse at regular intervals of approx. 1 m. The ground conveyor is equipped with an RFID reader, which reads the transponders in the floor. Its current position can be determined based on the data read out.

The object of the invention is to improve existing ground conveyors and their labeling such that content-related wrong and non-current labels and documentation are avoided in a cost effective manner with simple means.

BRIEF SUMMARY OF THE INVENTION

The ground conveyor according to the invention is equipped with one or more labels and/or documentation. The labels can for example be signs that contain information on the use and/or the safety of the ground conveyor. They can also be labels of components of the vehicle. The labels can also be informational labels on the assignment of buttons and control elements of the ground conveyor. Information sheets, information brochures and vehicle documents are provided for example as documentation for the ground conveyor. According to the invention, at least one label or documentation is provided with an RFID transponder, in which data on the content/meaning of the label or documentation is saved. The data in the RFID transponder is preferably an item number, for which content is saved in a memory. In the ground conveyor according to the invention, the use of RFID transponders makes it possible to mechanically read out labels or documentation of the vehicle. The easy mechanical readability of labels and documentation achieved by the RFID transponders creates a plurality of technical advantages. For example, when the ground conveyor is delivered, it can be checked whether its labels and documentation match the actual design of the ground conveyor. Furthermore, when the ground conveyor is delivered, the completeness of the labels and documentation can be checked.

In a preferred embodiment, a read device is provided on the ground conveyor, which can read out the data from the RFID transponder. The read device can be provided on the vehicle body or on the lifting boom or a comparable mount on the vehicle body. Through the read device provided on the ground conveyor, it is possible to also read out the data saved on the RFID transponders during the use of the vehicle. Alternatively, it is also possible to read out the data saved on the RFID transponders with an external read device. The external reader can be provided in a certain location and the data of the RFID transponders is read out when the ground conveyor drives by it or is located nearby. A mobile external read device, for example with a hand-held unit, can also be provided in order read out the data on the RFID transponders.

In a preferred embodiment, a control unit is provided, which controls the read device in order to read out the content of the labels. Such a control unit can read out the data in response to a command. It is also possible to read out the data at regular or irregular intervals. The control unit preferably compares the read data with the saved reference data. In this manner, deviations and error's in the label or the documentation can easily be determined. If the read device is integrated into the ground conveyor, then the control unit can directly control the reader. If an external read device is provided, then a data connection, for example a wireless connection, can be established between the control unit and the read device in order to transfer control signals and read-out data.

In a preferred embodiment, individual components of the ground conveyor are provided with RFID transponders, wherein information on the component is saved in the RFID transponder. It can be determined in this manner with which configuration of components the ground conveyor is equipped and what the associated technical properties of the ground conveyor are. It can also be determined that an incorrect component was used and a corresponding warning signal can subsequently be generated on the ground conveyor. It is also possible, if it is determined from a component that it is not the provided component, for example it is not detected or comes from a different manufacturer, to restrict the function of the ground conveyor in that for example only a reduced speed and/or a restricted lifting function is possible. The range of the vehicle can also be restricted for example so that the driver can only drive to a parking area.

In a preferred embodiment of the ground conveyor according to the invention, the control unit generates reference data from the received data on the components, which is compared with the read data on the label and/or documentation. In a preferred embodiment, the reference data can also be created based on the received data on the components and can be saved in a memory for later comparison with the data on the labels and/or documentation.

The invention is described in greater detail below for an exemplary embodiment.

BRIEF DESCRIPTION OF THE DRAWING OF THE INVENTION

FIG. 1 shows a perspective view of a ground conveyor 10 from the side. The ground conveyor has a vehicle body 12 and a lifting frame 14. The vehicle body 12 is equipped with a driver seat 16 and a schematically represented control panel 18.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated A sign 20 is attached in the driver's field of view, for example in the area of the control elements 18, which indicates what load can be lifted to which height. Furthermore, a second sign 22 is provided that contains additional general information on the vehicle. The control panel 18 itself is also provided with labels 22, which show the driver the functions of the individual control elements.

The signs 20, 22 and the labels on the control panel are both provided with a so-called smart label. A smart label is an ultra-flat RFID transponder, which is attached to a film with an antenna. This film is provided with spools and can be further processed together with the spools like paper or a plastic film. In the exemplary embodiment shown, the smart label is laminated into the signs 20, 22 and can thus be used like a conventional label. In addition to the laminated transponders, an RFID transponder can also be provided near the label, which can also be designed to be less flat than a smart label.

The inscriptions (not described in greater detail) for the control fields on the control panel 18 can also be equipped with a smart label or a conventional transponder.

The ground conveyor shown is also equipped with an RFID read device 24. As shown for example in the only FIGURE, the RFID reader 24 reads out the transponders on the control panel 18. It can be determined in a control unit (not shown) in this manner whether the function commands stored in the controller for the control elements match their label on the control panel 18.

The RFID reader 24 can also read the data on the transponder of the labels 20 and 22. It is thus possible to compare the read-out information of the sign 20 for example in the control unit with a specified reference value. The general data 22 can also be compared with the data stored in the control unit.

A few possible applications for the use of the transponders are described in greater detail below:

In one possible embodiment, the lifting frame for example is provided with an RFID label during assembly. The RFID label thereby consists of a type label readable for the user and an RFID transponder. For example, a label with the information on the lifting frame together with an incorporated transponder can be adhered to the lifting frame here. Alternatively, it is also possible that the label is embossed or stamped into the lifting frame and an RFID transponder is attached to the lifting frame. The relevant data on the lifting frame is saved in the transponder, whether it be the transponder prepared as a smart label or the separately attached transponder.

During the assembly of the ground conveyor, the information from the RFID transponder on the lifting frame is then read out and compared with the data read out from the load-bearing capacity sign 20.

The reading out of the data can thereby take place via the permanently connected read device for RFID transponders. It is also conceivable that only a mobile reader installed during assembly is used, which reads out both sets of data and compares them in an external control unit. It is also conceivable to provide in a stationary manner an external reader, which reads out the data when the ground conveyor is located nearby.

In a preferred embodiment, the vehicle has a permanently installed suitable read device, which reads out via the RFID transponder data and information on the lifting frame and the load-bearing capacity sign. It can thus also be checked during operation whether the data on the label matches that of the lifting frame. If it does not match, an error signal is triggered.

In a second exemplary embodiment, the function assignment of individual switches of individual control elements is checked. Today, it is possible to design the function assignment of individual switches in the ground conveyor based on customer requests. If this type of specific function assignment takes place, it must be ensured that the corresponding signage is also available on the vehicle. If this does not happen, this leads to serious safety problems, since the signage and the function assignment do not match. In order to verify the correct assignment here, the signs can be designed with an RFID transponder, which contains its own item number. It is then saved in the controller which item number corresponds with which function character on the sign. The first time that the vehicle is started up, the function assignments of the control element and the associated signs in the vehicle controller are then assigned to each other. Thus, the controller is set up here depending on the signage and not vice versa. In this exemplary embodiment, the inscriptions on the control panel are read out and the controller is set up accordingly. The special advantage of this is that the inscribed function elements are used to proceed, whereby safety problems are avoided in a particularly reliable manner.

Another application example for the invention relates to labeling requirements in certain countries. It is for example important for product liability reasons that certain warning messages be attached to the vehicle. In this embodiment of the invention, a series of item numbers for warning messages are thus saved in the controller of the ground conveyor, which much be present on the vehicle so that it can be delivered to the customer. The warning messages are designed with RFID transponders, which contain the corresponding item numbers. The read device on the device can query the signals of the signs before delivery so that it can be checked whether warning messages are still missing from the vehicle. The corresponding signs can then still be updated before delivery.

It can also be checked whether the vehicle has all signs during operation, for example before a shift begins. If it is determined from the read information that such a sign is missing, a corresponding warning message can be created.

In another exemplary embodiment, documents relating to the documentation of the ground conveyor can also be provided with an RFID transponder. In this manner, it can be checked whether the appropriate documentation is also on board during the operation of the ground conveyor. It can also be ensured through the allocation of specific item numbers for individual parts of the documentation that the correct content-related documentation for the ground conveyor is available. Such a check is performed for example during the delivery of the ground conveyor. It is also possible to check at regular intervals, such as e.g. at the start of a shift, whether the correct documentation is on board.

In a preferred exemplary embodiment, a reading of the data and a check of the data takes place before the ground conveyor is started. The read device is thereby activated by a run-up controller and the RFID transponders located in the area are read out by the read device.

In a subsequent step, the read-out data is compared with reference values saved on the vehicle. If the read-out data matches the saved reference values, the vehicle is then started. If it does not match, then an error message is generated for the driver before the vehicle is started.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A ground conveyor comprising:

a vehicle body;

a lifting frame;

a first label provided on a first component of the ground conveyor, the first label having visual information on a use or safety requirement of the ground conveyor, the first label having a first RFID transponder, in which data related to the content of the visual information is saved;

a second RFID transponder provided on a second component of the ground conveyor, wherein data related to the second component is saved in the second RFID transponder; and a read device mounted on the vehicle body or the lifting frame wherein the read device reads out data from the first and second RFID transponders and transmits the data to a control unit via a data connection;

wherein said control unit compares the data related to the second component saved on the second RFID transponder with the data from the first RFID transponder related to the visual information of the first label to determine whether the second component satisfies the use or safety requirement shown on the first label.

2. The ground conveyor according to claim 1, characterized in that the control unit compares the data with saved reference data.

3. The ground conveyor according to claim 1, characterized in that a smart label is provided as the RFID transponder.

4. The ground conveyor according to claim 1, further comprising a vehicle controller, wherein the control unit generates the corresponding function assignment for a control element in the vehicle controller from the read data of a label for the control element.

5. The ground conveyor according to claim 1, wherein the first component of the ground conveyor is the vehicle body and the second component of the ground conveyor is the lifting frame.

* * * * *